US006909237B1

(12) United States Patent
Park et al.

(10) Patent No.: US 6,909,237 B1
(45) Date of Patent: Jun. 21, 2005

(54) PRODUCTION OF STABLE, NON-THERMAL ATMOSPHERIC PRESSURE RF CAPACITIVE PLASMAS USING GASES OTHER THAN HELIUM OR NEON

(75) Inventors: Jaeyoung Park, Los Alamos, NM (US); Ivars Henins, Los Alamos, NM (US)

(73) Assignee: The Regents of the University of California, Los Alamos, NM (US)

( * ) Notice: Subject to any disclaimer, the term of this patent is extended or adjusted under 35 U.S.C. 154(b) by 0 days.

(21) Appl. No.: 10/205,786

(22) Filed: Jul. 25, 2002

(51) Int. Cl.[7] ..... H01J 7/24
(52) U.S. Cl. ..... 315/111.21; 445/16
(58) Field of Search ..... 315/111.21, 326, 315/358; 156/345.33; 118/723 R; 445/15–18

(56) References Cited

U.S. PATENT DOCUMENTS 5,221,427 A * 6/1993 Koinuma et al. ..... 216/67
5,384,167 A * 1/1995 Nishiwaki et al. ..... 427/569
5,565,036 A * 10/1996 Westendorp et al. .. 118/723 MP
5,735,451 A * 4/1998 Mori et al. ..... 228/206
5,753,886 A * 5/1998 Iwamura et al. ..... 219/121.43
5,789,867 A * 8/1998 Westendorp et al. .... 315/111.21
6,158,648 A * 12/2000 Mori et al. ..... 228/206
6,441,553 B1 * 8/2002 Yializis et al. ..... 315/111.21
2003/0155332 A1 * 8/2003 Datta et al. ..... 219/121.52

* cited by examiner

*Primary Examiner*—Thuy Vinh Tran
(74) *Attorney, Agent, or Firm*—Milton D. Wyrick; Mark N. Fitzgerald

(57) ABSTRACT

The present invention enables the production of stable, steady state, non-thermal atmospheric pressure rf capacitive α-mode plasmas using gases other than helium and neon. In particular, the current invention generates and maintains stable, steady-state, non-thermal atmospheric pressure rf α-mode plasmas using pure argon or argon with reactive gas mixtures, pure oxygen or air. By replacing rare and expensive helium with more readily available gases, this invention makes it more economical to use atmospheric pressure rf α-mode plasmas for various materials processing applications.

9 Claims, 2 Drawing Sheets

A. Breakdown of helium
B. Argon addition
C. Stop helium flow (start transition from He + Ar plasmas to pure Ar plasmas)

PRODUCTION OF STABLE, NON-THERMAL ATMOSPHERIC PRESSURE RF CAPACITIVE PLASMAS USING GASES OTHER THAN HELIUM OR NEON

STATEMENT REGARDING FEDERAL RIGHTS

This invention was made with government support under Contract No. W-7405-ENG-36 awarded by the U.S. Department of Energy to The Regents of The University of California. The government has certain rights in the invention.

FIELD OF THE INVENTION

The present invention relates generally to the production of stable, steady-state, non-thermal atmospheric pressure rf capacitive a-mode plasmas and, more particularly, to the use of gases other than helium and neon as majority species in such discharges.

BACKGROUND OF THE INVENTION

Existing methods of producing rf a-mode plasmas at atmospheric pressure rely on either the use of helium as a majority species (more than 50% of the gas composition) or the use of pre-ionizing mechanisms such as electron beam excitation or laser irradiation. When helium is used as a majority gas species, the rarity and the cost of helium make the technology less attractive economically. The use of electron beam excitation or laser irradiation makes the technology difficult and complicated to implement in a wide range of applications. Applications of atmospheric pressure plasmas include, but are not limited to, various semiconductor manufacturing processes, such as photo-resist removal. The plasmas also can be applied to medical and food sterilization, and cleaning of contaminated surfaces.

Accordingly, it is an object of the present invention to make the use of atmospheric pressure rf a-mode plasmas economical and convenient for various applications.

It is another object of the present invention to use less expensive and available gases such as argon and oxygen.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

In accordance with the purposes of the present invention, as embodied and broadly described herein, a method of producing an atmospheric pressure rf capacitive α-mode plasma between two electrodes having a gap greater than 0.1 cm using gases other than helium or neon comprises the steps of connecting a rf voltage between the two electrodes; introducing a flow of helium between the two electrodes; increasing the rf voltage until said helium breaks down; introducing a flow of a gas other than helium or neon between the two electrodes; stopping the flow of helium; wherein a sustained a-mode plasma exists between the two electrodes.

In a further aspect of the present invention, and in accordance with its objects and principles, a method of producing an atmospheric pressure rf capacitive α-mode plasma between two electrodes having a gap and using gases other than helium or neon comprises the steps of making the spacing of said gap between said two electrodes equal to or less than 0.08 cm; connecting a rf voltage source having a frequency greater than or equal to 13.56 MHz; introducing a gas other than helium or neon between said two electrodes thereby initiating a plasma.

BRIEF DESCRIPTION OF THE DRAWINGS

The accompanying drawing, which is incorporated in and forms a part of the specification, illustrates an embodiment of the present invention and, together with the description, serve to explain the principles of the invention. In the drawing.

DETAILED DESCRIPTION

Figure 1:
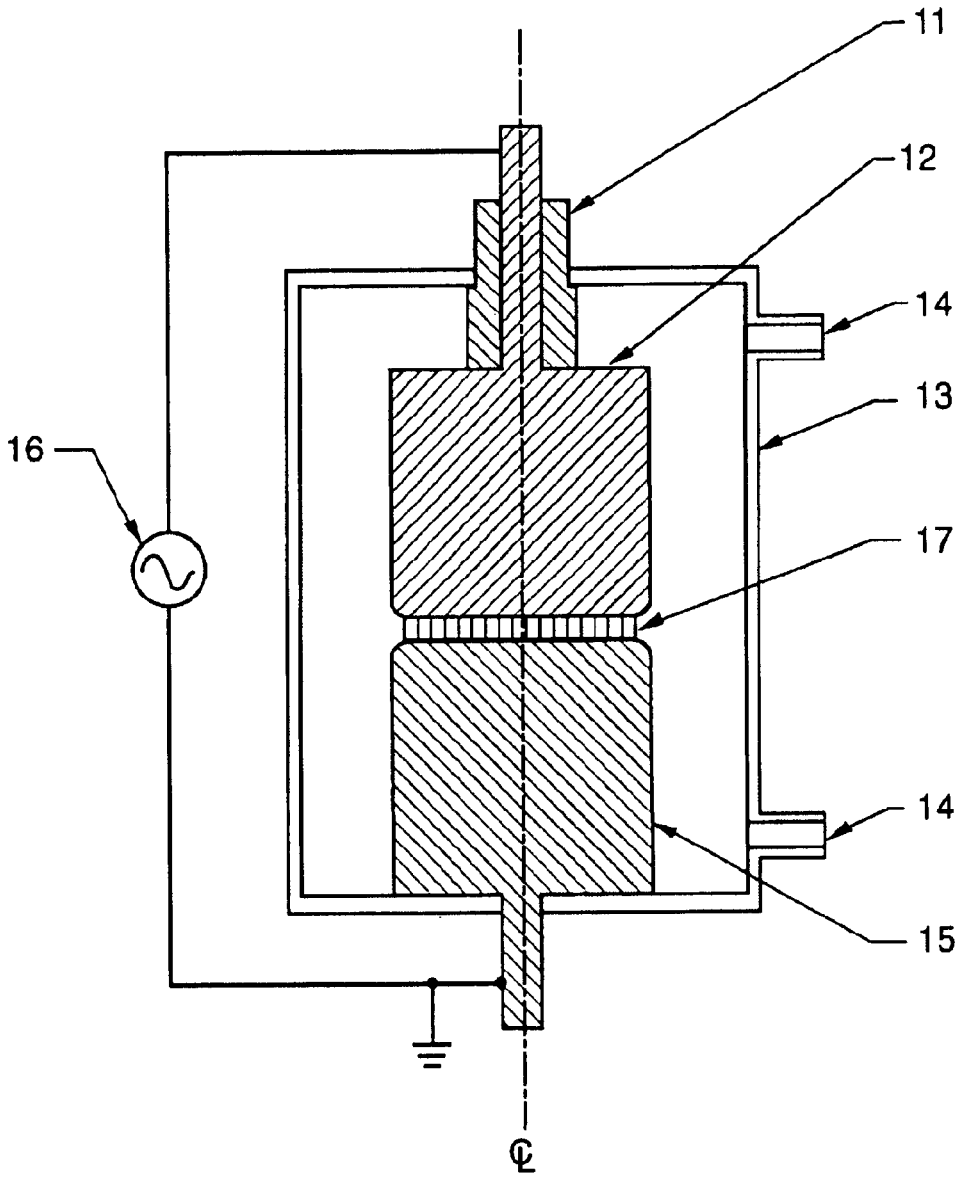
Fig. 1 (Prior Art)
FIG. 1 is a schematical illustration of a typical atmospheric pressure plasma processor with which the present invention can be used.

The present invention avoids one of the principal difficulties for initiating and maintaining the stable, atmospheric pressure rf α-mode plasmas. At high gas pressure (>100 torr), the breakdown voltage for most gases generally exceeds 200 V rms, except in the cases of helium and neon for a reasonable gap spacing (>1 mm) between electrodes. By comparison, rf α-mode plasmas turn into an undesirable γ-mode or an arc when the discharge voltage exceeds a critical voltage, generally around 200 V rms. Thus, rf breakdown using capacitive electrodes does not produce stable rf α-mode plasmas for gases other than helium or neon, as the discharge turns into a y-mode or an arc immediately after breakdown for those other gases.

In fact, the production of steady-state, non-thermal atmospheric pressure rf α-mode plasmas using gases other than helium or neon has not been realized prior to this invention for a reasonable gap size of >1 mm. This invention is based on the principle that atmospheric pressure rf a-mode discharge is generally maintained at a lower rf voltage than the voltage required for breakdown.

In practice of the present invention, the discharge is initiated using a condition that reduces the breakdown voltage for a given electrode geometry. For example, the discharge can be initiated in the α-mode by a relatively low breakdown voltage (1) by briefly (for a few seconds) introducing helium in the discharge region; or (2) using a small gap spacing between electrodes (0.08 cm or less) and/or use of high rf frequency (>13.56 MHz).

After discharge is initiated, the discharge can be sustained in the α-mode while a gradual change is made to transform it to a stable, non-thermal atmospheric pressure rf α-mode plasma using gases other than helium or neon. The discharge can be sustained in the α-mode while gradual changes (on the order of a few seconds) are made in the gas composition without initiating a transition to a γ-mode or an arc. This is done by gradually introducing other gases and removing the helium or neon from the discharge.

The α-mode also can be initiated without the use of helium or neon with a small gap spacing (0.08 cm or less). After discharge is initiated, the α-mode can be sustained while gradually increasing the gap spacing.

FIG. 1 illustrates an example of an atmospheric pressure plasma processor capable of efficacious operation with the teachings of the present invention. As seen, insulator 11 insulates RF powered electrode 12 from grounded enclosure 13. Grounded enclosure 13 provides support for the electrodes of the processor and defines gas inlets/outlets 14. Grounded electrode 15 also is mounted to grounded enclosure 13 and is in physical and electrical contact with grounded enclosure 13. Grounded electrode 15 is mounted so that a small gap exists between grounded electrode 15 and RF powered electrode 12. RF power supply 16 is connected between RF powered electrode 12 and grounded electrode 15. With a gas mixture as taught herein flowing through gas inlets/outlets 14 and RF power supply 16 providing an appropriate voltage and frequency between RF powered electrode 12 and grounded electrode 15, an atmospheric pressure plasma 17 is created between RF powered electrode 12 and grounded electrode 15.

Figure 2:
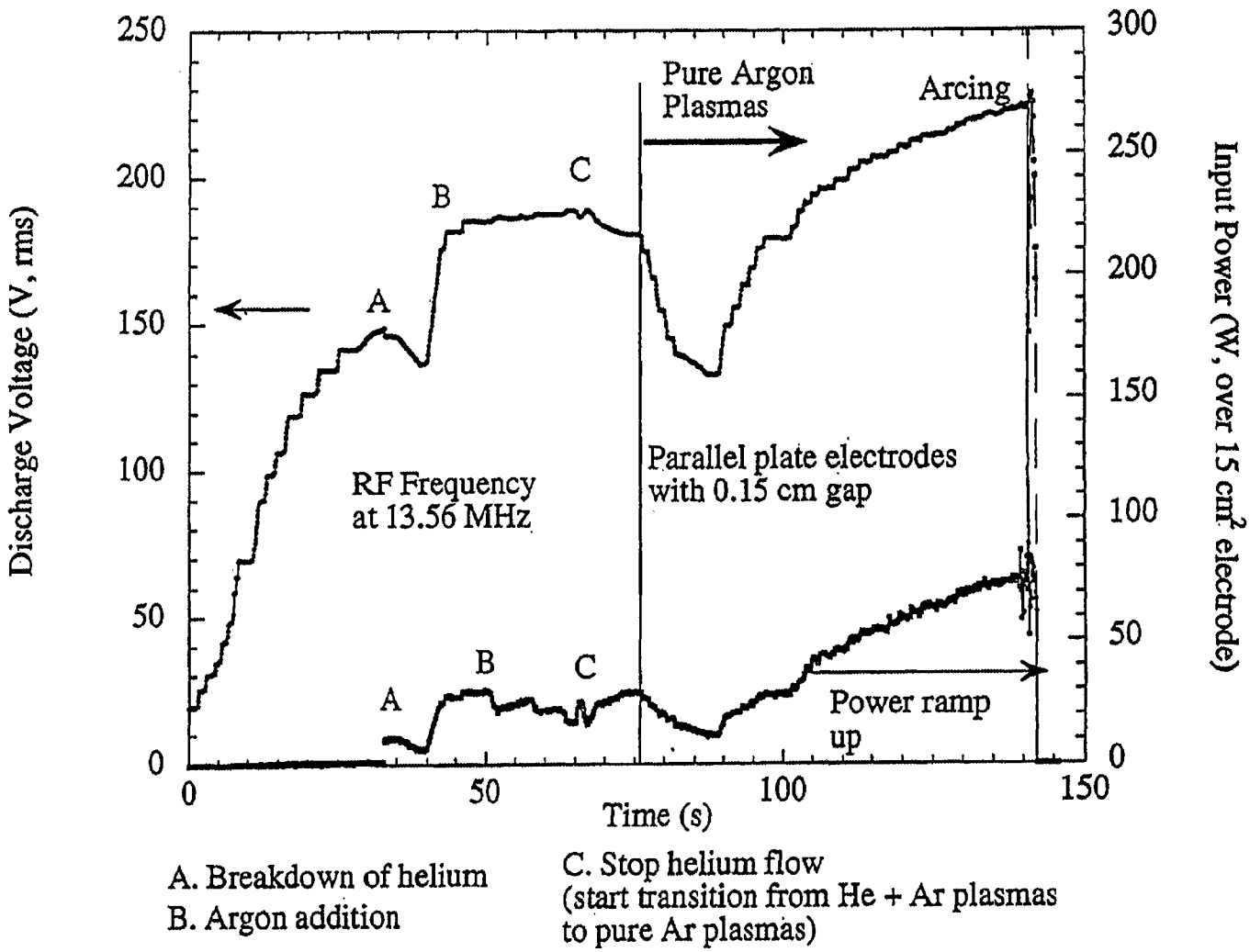
FIG. 2 is a plot of discharge voltage and input power versus time showing the formation of a pure argon discharge beginning with a helium plasma to achieve breakdown.

An illustration of the operation of one embodiment of the present invention operating at a rf frequency of 13.56 MHz is contained in FIG. 2. As seen in FIG. 2, helium is introduced between parallel plates having an area of 15 $cm^2$ and a 0.15 cm gap, at time=0, and the applied rf voltage is increased until it reaches breakdown voltage of approximately 150 V, at time≈35 sec. Argon is then introduced. At time≈65 sec, the helium flow is stopped and a pure Argon plasma is established from t≈76 sec. When the applied rf voltage is increased to approximately 225 V, arcing occurs. However as shown, below that voltage, the pure Argon atmospheric pressure plasma was sustained.

To date, the present invention has demonstrated that stable, steady-state, non-thermal atmospheric pressure rf α-mode plasmas using pure argon or argon with reactive gas mixtures can be produced by all three of the above described methods. This invention is compatible with any electrode geometry such as parallel plate or co-axial configuration that are used for production of rf α-mode plasmas at medium pressure (>10 torr to above atmospheric pressure). Although the direct demonstration of this invention was made with bare electrodes using parallel plate and co-axial configuration, the use of dielectric materials over the one or both electrodes will be equally compatible. This is because the dielectric materials do not affect the formation of rf α-mode plasmas.

However, dielectrics affect the value of the critical discharge voltage over which the α-mode plasmas turn into the undesirable γ-mode or an arc. In fact, dielectric covered electrodes can be used to produce atmospheric pressure rf α-mode plasmas using gases without the use of helium or neon. This is because the presence of a dielectric increases the critical discharge voltage of the γ-mode transition without causing a large change in the breakdown voltage. In addition, it should be noted that this invention uses a wide range of rf frequencies, from 13.56 MHz up to 200 MHz, although it has only so far been demonstrated up to 35 MHz. But, extrapolation to 200 MHz should be straightforward, as pointed in a number of articles in the literature regarding the advantage of higher frequency operation of rf a-mode plasmas.

It is also anticipated that a very short pulse (on the order of a few microseconds) of high voltage followed by a steady-state low rf voltage will achieve the same effect. Thus, the discharge can be initiated and sustained as a stable α-mode plasma using gases other than helium or neon without it turning into a γ-mode or an arc. Once produced, atmospheric pressure rf α-mode plasmas can be used for various materials processing applications. One example would be the removal of photo-resist using an argon and oxygen gas mixture. It is noted that the process of the present invention may use other gases, such as pure oxygen.

Benefits and advantages of the invention include replacing rare and expensive helium with more readily available gases, making it more economical to use atmospheric pressure rf α-mode plasmas for various materials processing applications.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A method of producing an atmospheric pressure rf capacitive α-mode plasma between two electrodes having a gap greater than 0.1 cm using gases other than helium or neon comprising the steps of:

connecting a rf voltage between said two electrodes;

introducing a flow of helium or neon between said two electrodes;

increasing said rf voltage until said helium or neon breaks down;

introducing a flow of a gas other than helium or neon between said two electrodes;

stopping said flow of helium or neon;

wherein a sustained α-mode plasma exists between said two electrodes.

2. The method as described in claim 1 wherein said rf voltage has a frequency of 13.56 MHz.

3. The method as described in claim 1 wherein said gas other than helium or neon is argon.

4. The method as described in claim 1 wherein said gas other than helium or neon is argon and a mixture of reactive gases.

5. The method as described in claim 1 wherein said gas other than helium or neon is pure oxygen.

6. A method of producing an atmospheric pressure rf capacitive α-mode plasma between two electrodes having a gap and using gases other than helium or neon comprising the steps of:

making the spacing of said gap between said electrodes equal to or less than 0.08 cm;

connecting a rf voltage device source having a frequency greater than or equal to 13.56 MHz;

introducing a gas other than helium or neon between said two electrodes thereby initiating a plasma; and increasing said spacing of said gap between said two electrodes to be equal to or greater than 0.1 cm to sustain said atmospheric pressure rf plasma capacitive α-mode plasma.

7. The method as described in claim 6, wherein said gas other than helium or neon is argon.

8. The method as described in claim 6 wherein said gas other than helium or neon is argon and a mixture of reactive gases.

9. The method as described in claim 6 wherein said gas other than helium or neon is pure oxygen.

* * * * *